US007574804B2

(12) United States Patent
Bezold et al.

(10) Patent No.: US 7,574,804 B2
(45) Date of Patent: Aug. 18, 2009

(54) KNIFE WITH SLIDING BLADE AND DISENGAGEABLE DEPLOYMENT MECHANISM

(75) Inventors: Urs Bezold, Weissenohe (DE); Craig Green, Sherwood, OR (US)

(73) Assignee: KAI U.S.A., Ltd., Tualatin, OR (US)

( * ) Notice: Subject to any disclaimer, the term of this patent is extended or adjusted under 35 U.S.C. 154(b) by 0 days.

(21) Appl. No.: 11/355,202

(22) Filed: Feb. 14, 2006

(65) Prior Publication Data

US 2006/0207102 A1 Sep. 21, 2006

(30) Foreign Application Priority Data

Mar. 18, 2005 (DE) ..... 10 2005 014 706

(51) Int. Cl.
*B26B 1/08* (2006.01)

(52) U.S. Cl. ..... 30/162; 30/151

(58) Field of Classification Search ..... 30/151, 30/152, 162, 163, 164, 335, 336; 224/232, 224/233

See application file for complete search history.

(56) References Cited

U.S. PATENT DOCUMENTS

| | | | | | |
|---|---|---|---|---|---|
| 57,902 | A | | 9/1866 | Hibbard | 30/162 |
| 825,976 | A | * | 7/1906 | Neiglick | 30/162 |
| 845,792 | A | | 3/1907 | Jenkins | |
| 1,057,525 | A | | 4/1913 | Bruecker | 30/162 X |
| 1,496,188 | A | | 6/1924 | Wall | 30/162 |
| 1,725,064 | A | * | 8/1929 | Easton | 30/123 |
| 1,738,496 | A | | 12/1929 | Laux | 30/162 X |
| 1,906,573 | A | * | 5/1933 | Gits | 30/320 |
| 1,960,130 | A | * | 5/1934 | Trubel | 30/320 |
| 2,141,061 | A | * | 12/1938 | Dobson | 30/162 |
| 2,284,168 | A | | 5/1942 | Rickenbacher | 30/162 |
| 2,455,765 | A | | 12/1948 | Harvey | 248/360 |
| 2,569,080 | A | | 9/1951 | Trimble et al. | 30/320 |
| 2,611,178 | A | * | 9/1952 | Whipple et al. | 30/162 |
| 3,079,686 | A | * | 3/1963 | Christy | 30/162 |
| 3,216,288 | A | * | 11/1965 | Gardner | 408/202 |
| 3,314,148 | A | * | 4/1967 | Foellmi | 30/162 |
| 3,863,339 | A | * | 2/1975 | Reaney et al. | 30/162 |
| 4,211,003 | A | | 7/1980 | Collins | 30/162 |

(Continued)

FOREIGN PATENT DOCUMENTS

| | | |
|---|---|---|
| DE | 26309 | 3/1884 |

(Continued)

*Primary Examiner*—Hwei-Siu C Payer
(74) *Attorney, Agent, or Firm*—Seed IP Law Group PLLC

(57) ABSTRACT

A knife assembly includes a handle having a blade cavity and a deployment slot extending longitudinally in the handle. A blade is slidably positioned within the blade cavity, and is slidable between a retracted position, in which the blade is wholly enclosed within the handle, and an extended position, in which a portion of the blade extends from a first end of the handle. A clip assembly includes a pin configured to releasably engage a tang portion of the blade in the blade cavity via the deployment slot. While the pin engages the blade, it can traverse the deployment slot from a first end to a second end to move the blade between the extended and retracted positions. The handle is configured to hang from the pin at the second end of the deployment slot while the blade is in the retracted position.

22 Claims, 8 Drawing Sheets

U.S. PATENT DOCUMENTS

| | | | | |
|---|---|---|---|---|
| 4,389,775 | A | 6/1983 | Collins | 30/156 |
| 4,466,561 | A | 8/1984 | Slaughter | 224/163 |
| 4,494,309 | A | 1/1985 | Gray | 30/151 |
| 4,494,310 | A | 1/1985 | Slaughter | 30/155 |
| 4,525,928 | A | 7/1985 | Foster | 30/158 |
| 4,529,111 | A | 7/1985 | Hayakawa | 224/163 |
| 4,541,556 | A | 9/1985 | Collins et al. | 224/196 |
| 4,561,577 | A | 12/1985 | Moore | 224/232 |
| 4,600,133 | A | 7/1986 | Maihos | 224/232 |
| 4,805,819 | A | 2/1989 | Collins | 224/232 |
| 4,848,000 | A | 7/1989 | O'Dell | 30/158 |
| 4,909,424 | A | 3/1990 | Reynolds | 224/232 |
| 5,123,167 | A | 6/1992 | Kelley | 30/151 |
| 5,217,150 | A | 6/1993 | Chen | 224/163 |
| 5,217,151 | A | 6/1993 | Parsons | 224/253 |
| 5,349,753 | A | 9/1994 | Gaffney | 30/155 |
| 5,361,497 | A | 11/1994 | Crawford | 30/155 |
| 5,450,670 | A | 9/1995 | Sakai | 30/298.4 |
| 5,511,311 | A | 4/1996 | Collins | 30/162 |
| 5,584,123 | A * | 12/1996 | Chi | 30/125 |
| 5,822,867 | A | 10/1998 | Sakai | 30/298.4 |
| 5,878,500 | A | 3/1999 | Emerson | 30/158 |
| 6,363,614 | B1 * | 4/2002 | Umstead et al. | 30/144 |
| 6,442,843 | B1 | 9/2002 | Jue et al. | 30/151 |
| 7,086,158 | B1 | 8/2006 | Halpern et al. | |
| D560,994 | S * | 2/2008 | Green | D8/99 |
| 2002/0095792 | A1 | 7/2002 | Jue et al. | 30/151 |
| 2003/0089750 | A1 | 5/2003 | Martinez | 224/232 |

FOREIGN PATENT DOCUMENTS

| | | |
|---|---|---|
| DE | 197 40 875 | 6/1998 |
| EP | 0 230 000 | 7/1987 |
| EP | 0 396 938 | 11/1990 |
| FR | 2 696 671 | * 10/1992 |

* cited by examiner 100
118
125
108
126
122
128
112
127
142
124
120
140
154
148
144
134
110

D
100
130
144
154
140
134
148
126
128
122
108
124

100
130
144
154
140
126
125
156
152
124
142
128
134
108

KNIFE WITH SLIDING BLADE AND DISENGAGEABLE DEPLOYMENT MECHANISM

CROSS-REFERENCE TO RELATED APPLICATION

This application claims the benefit of German Patent Application No. 10 2005 014 706.2 filed Mar. 18, 2005, which application is incorporated herein by reference in its entirety.

BACKGROUND OF THE INVENTION

1. Field of the Invention

This invention relates to knives, and in particular, to a knife that is easy to deploy.

2. Description of the Related Art

Knives have long been used to perform a variety of tasks, and knife designs have been adapted accordingly. While some knives are designed for extremely specialized applications, many people carry knives for general purpose use, and there is a significant demand for knives that are useful for a broad range of applications. Two categories of knives are fixed blade knives, and pocket knives. Fixed blade knives generally comprise a handle and a blade rigidly fixed together and configured to be received into a sheath or scabbard that may be attached to the user's belt. Fixed blade knives provide many advantages, including ease of access and robust construction. The handle and blade of a fixed blade knife that is carried on a belt is generally around eight inches long, or longer. A knife of this size hanging from one's belt tends to interfere with normal movement, such as entering and exiting vehicles, sitting and bending, etc. Additionally, a knife of this size can attract the attention and concern of those around the user.

A pocket knife generally includes a handle and a blade coupled to each other in such a way that the blade can be stored within a cavity inside the handle. Most common of these are folding knives, in which the blade is pivotally mounted at one end of the handle such that it can be rotated around the pivot and folded into the cavity in the handle. In other cases, the blade may be slideably mounted to the handle such that the blade is translatable between a retracted position in which the blade resides in the cavity inside the handle, and an extended position in which the blade extends from an opening at one end of the handle for use. Such knives are often referred to as out-the-front (OTF) knives. While folding and OTF knives are referred to here as pocket knives, in many cases such knives are provided with other means for carrying. For example, belt sheaths are often used with such knives, especially in the case of larger knives. The belt sheath allows a user to carry the knife without having its weight and bulk within a trouser pocket. Even though when deployed such a knife may be as long or longer than belt knife described above, it occupies a much smaller area while stored and thus presents fewer problems for the user, both as a practical matter and in appearance. Another common adaptation for carrying a pocket knife is the use of a pocket clip: generally, a spring clip that extends down one side of the knife handle and is used to clip the knife into the user's pocket or on the user's belt.

While pocket knives do not suffer from the disadvantages inherent with belt knives, they do have disadvantages of their own. For example, preparing to use a pocket knife is generally more complicated than deploying a belt knife, since it includes removing the knife from the pocket or sheath, and then unfolding or extending the blade to a position for use. The act of deploying a blade often requires that the user insert a thumbnail into a notch formed along the back edge of the blade in order to pull the blade out of the handle, or may require that the user press against a stud to rotate the blade out of the handle. In many cases, two hands are required to deploy a blade in a pocket knife. An early solution to this problem was the creation of automatic knives, or switchblades, in which a spring-loaded mechanism is provided such that, when a user presses a release button on the handle of the knife, the spring moves the blade from the stored position to the extended position. With such a mechanism, it is possible to easily deploy the blade of a knife with one hand, thereby resolving many of the difficulties associated with pocket knives. At one time, automatic knives were very popular. However, laws passed in the 1950's generally made automatic knives illegal for carrying.

Recently, other knife designs have emerged for knives that can be opened with one hand in order to provide users with greater convenience and practicality. However, even in these newer designs, a certain degree of dexterity is required in order to open the blades, and there are many applications where a more easily deployable knife would be very useful. For example, if a user is in an environment where gloves are required, it may be still be difficult to manipulate thumb studs or move release levers in order to open a knife. Thus, there remains a demand for improved knife designs, particularly in the area of one-handed knives.

BRIEF SUMMARY OF THE INVENTION

According to an embodiment of the invention, a knife assembly comprises a handle having a blade cavity and a deployment slot extending longitudinally in the handle. A blade is positioned within the blade cavity, and is slidable between a retracted position in which the blade is wholly enclosed within the handle, and an extended position in which a portion of the blade extends from a first end of the handle. The knife assembly includes a clip assembly with a pin configured to releasably engage a tang portion of the blade in the blade cavity through the deployment slot. While the pin engages the blade, it can traverse the deployment slot from a first end to a second end to move the blade between the extended and retracted positions. The handle is configured to hang from the pin at the second end of the deployment slot while the blade is in the retracted position.

The clip assembly includes a support member such as a belt clip, and the pin includes a head and a body that extends along a first axis between the support member and the head of the pin such that, when the pin traverses the deployment slot, the body extends between the head and the support member via the deployment slot.

The handle includes a release aperture at the first end of the deployment slot that has a diameter that is greater than a diameter of the head of the pin and is configured to removably receive the head, while the deployment slot has a width that is less than the diameter of the head, so as to capture the pin while the pin traverses the slot.

According to an embodiment, the body of the pin has a first dimension along a second axis, perpendicular to the first axis, that is less than the width of the deployment slot, and a second dimension along a third axis, perpendicular to the first and second axes, that is greater than the width of the deployment slot. A swivel aperture is formed in the handle at the second end of the deployment slot, and has a diameter that is greater than the second dimension of the body and less than the diameter of the head. Accordingly, when the handle hangs from the pin with the pin positioned at the swivel aperture, it can swivel on the pin, but in order to move the pin along the deployment aperture, the handle must be positioned so that the second axis of the body is approximately perpendicular to the deployment slot.

The body of the pin is oriented on the clip assembly such that, when the handle hangs from the pin, the second axis of the body is substantially parallel to the deployment slot of the handle, effectively preventing the blade, engaged to the head of the pin, from moving toward the extended position.

DETAILED DESCRIPTION OF THE INVENTION

In the following description, certain specific details are set forth in order to provide a thorough understanding of various embodiments of the invention. However, one skilled in the art will understand that the invention may be practiced without these details.

Figure 1:
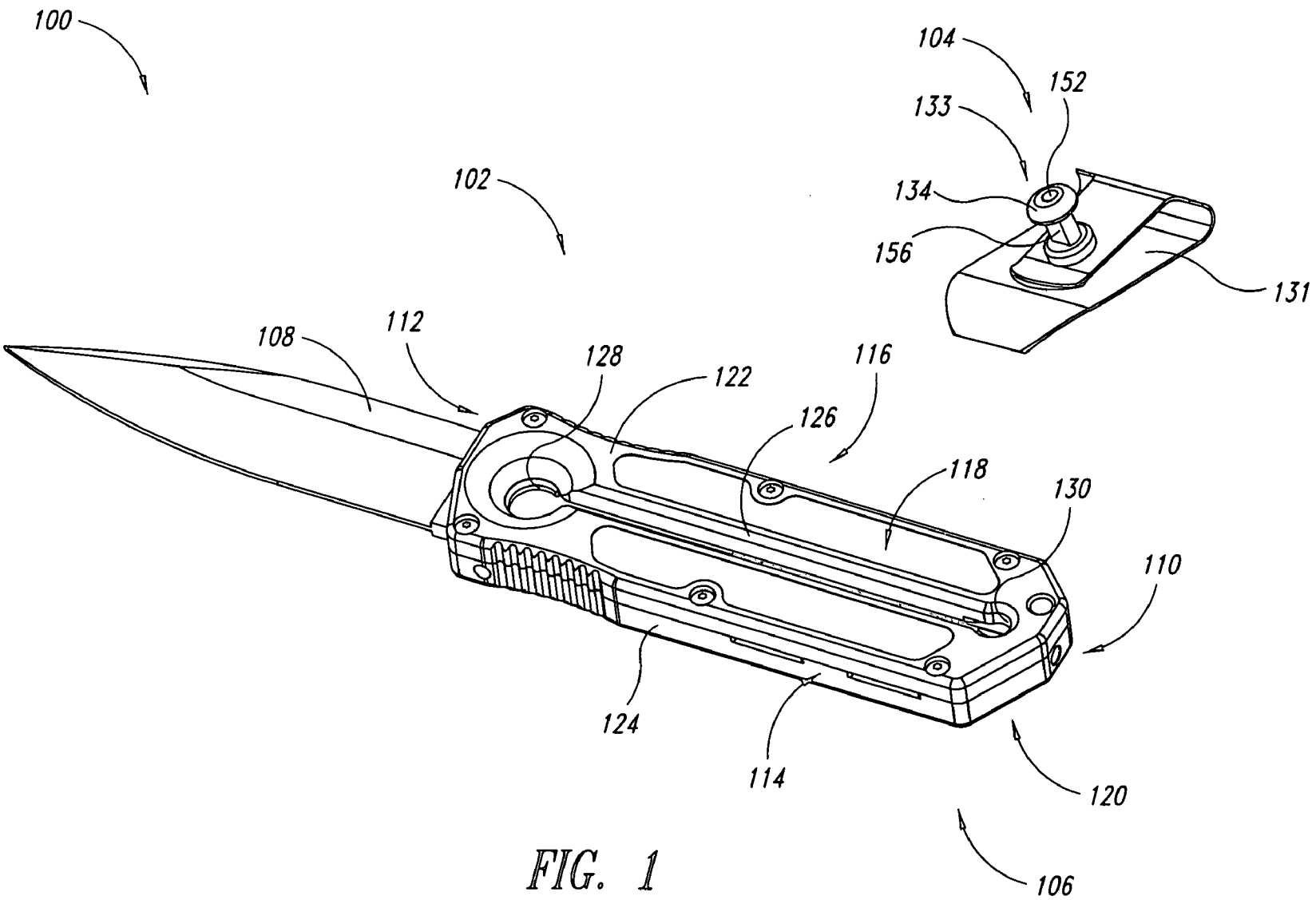
FIG. 1 is a perspective view of a knife assembly according to an embodiment of the invention, in which the blade is in the extended position.

FIG. 1 shows a knife assembly 100 according to an embodiment of the invention. In describing components of the knife assembly 100, terms such as front, back, top, and bottom, may be used, as well as other terms to indicate direction, orientation, etc. such terms are for convenience only, in order to more clearly make reference to particular features. The scope of the present invention is not limited by such terms.

The knife assembly 100 includes a knife 102 and a clip assembly 104. The clip assembly 104 is configured to attach to a user's belt or the like, and to receive thereon the knife 102 for storage, as will be described in more detail hereafter.

The clip assembly 104 comprises a clip 131 and a pin 133, with a body 156 extending between the clip 131 and a head 134. The body 156 is oblong in cross section, the purpose for which will be described further with reference to FIGS. 5A and 5B.

Figure 2:
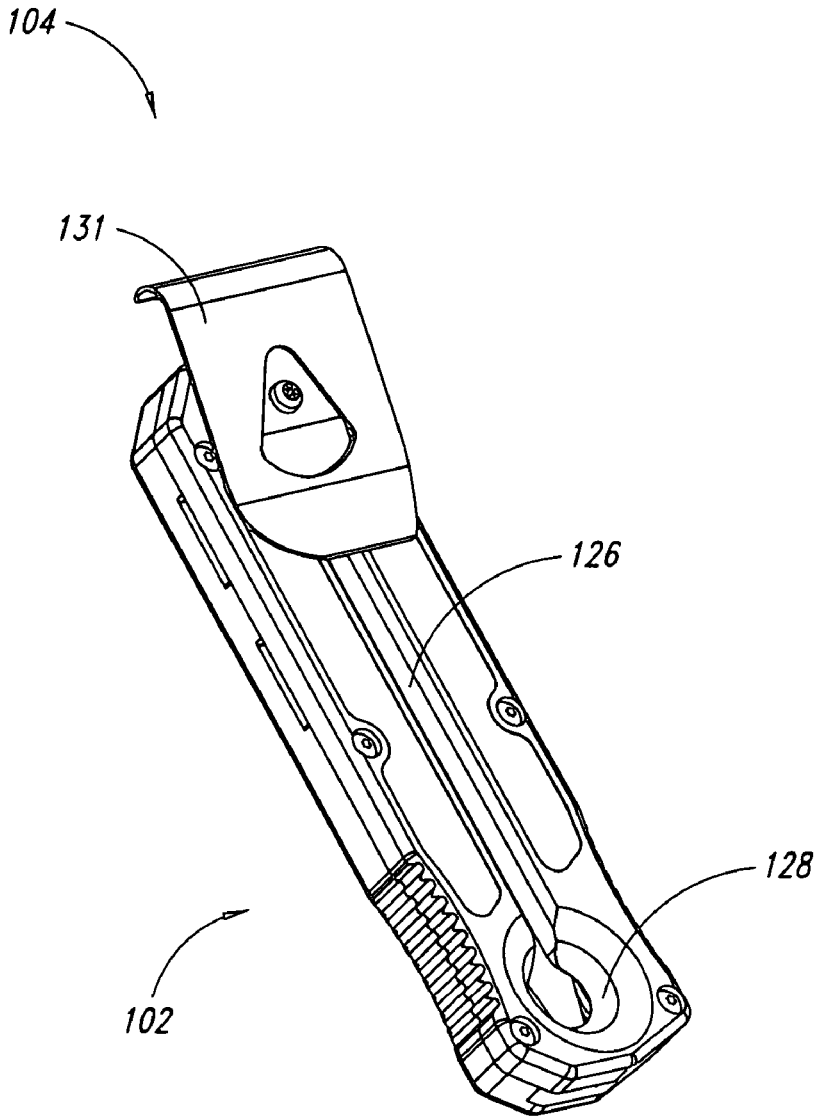
FIG. 2 is an illustration of the knife of FIG. 1, in which the blade is in a retracted position within the handle.

The knife 102 includes a blade 108 coupled to a handle 106 and translatable between an extended position in which the blade 108 extends from the handle 106 as shown in FIG. 1, and a retracted position in which the blade 108 is received within a blade cavity 125 as shown in FIG. 2. As shown in FIG. 1, The handle 106 has first and second ends 112, 110, a top and bottom 116, 114, and front and back sides, 118, 120. The handle 106 includes front and back covers 122, 124 that define between them the blade cavity 125 into which the blade 108 is received for storage in the retracted position.

The front cover 122 has a deployment slot 126 formed therein, with a release aperture 128 at a first end thereof and a swivel aperture 130 at a second end. The deployment slot 126 is configured such that the pin 133 of the clip assembly 104 may be inserted through the release aperture 128 into the blade cavity 125, and slid along the slot to the swivel aperture 130, with the body 156 extending from the head 134 inside the blade cavity 125 to the clip 131 outside the handle 106. The release aperture 128 has a conical shape that facilitates engagement between the release aperture 128 and the head 134.

In operation, when storing the blade in the handle, the user positions the knife 102 such that the release aperture 128 is approximately aligned with the pin 133 extending from the clip assembly 104 and moves the knife 102 against the clip assembly 104 until the head 134 enters the blade cavity 125 via the release aperture 128. The user then moves the knife 102 such that the head 134 travels within the blade cavity 125 toward the second end 110 of the knife handle 106. As the head 134 moves along within the blade cavity 125, the blade 108 is drawn into the blade cavity 125 of the handle 106 for storage. Once the pin 133 begins moving along the deployment slot 126 from the release aperture 128, the head 134 is captured within the blade cavity 125 by the narrower deployment slot 126.

Referring now to FIG. 2, the knife assembly 100 is shown with the knife 102 and clip assembly 104 coupled together as they would be when the knife 102 is not in use. In this configuration, and with the clip 131 coupled to a user's belt, the handle 106 of the knife 102 hangs downward from the clip assembly 104 attached to the user's belt. Though not visible in FIG. 2, the blade 108 is received in the blade cavity 125 and the pin 133 is engaged to the handle 106 via the swivel aperture 130.

Figure 3:
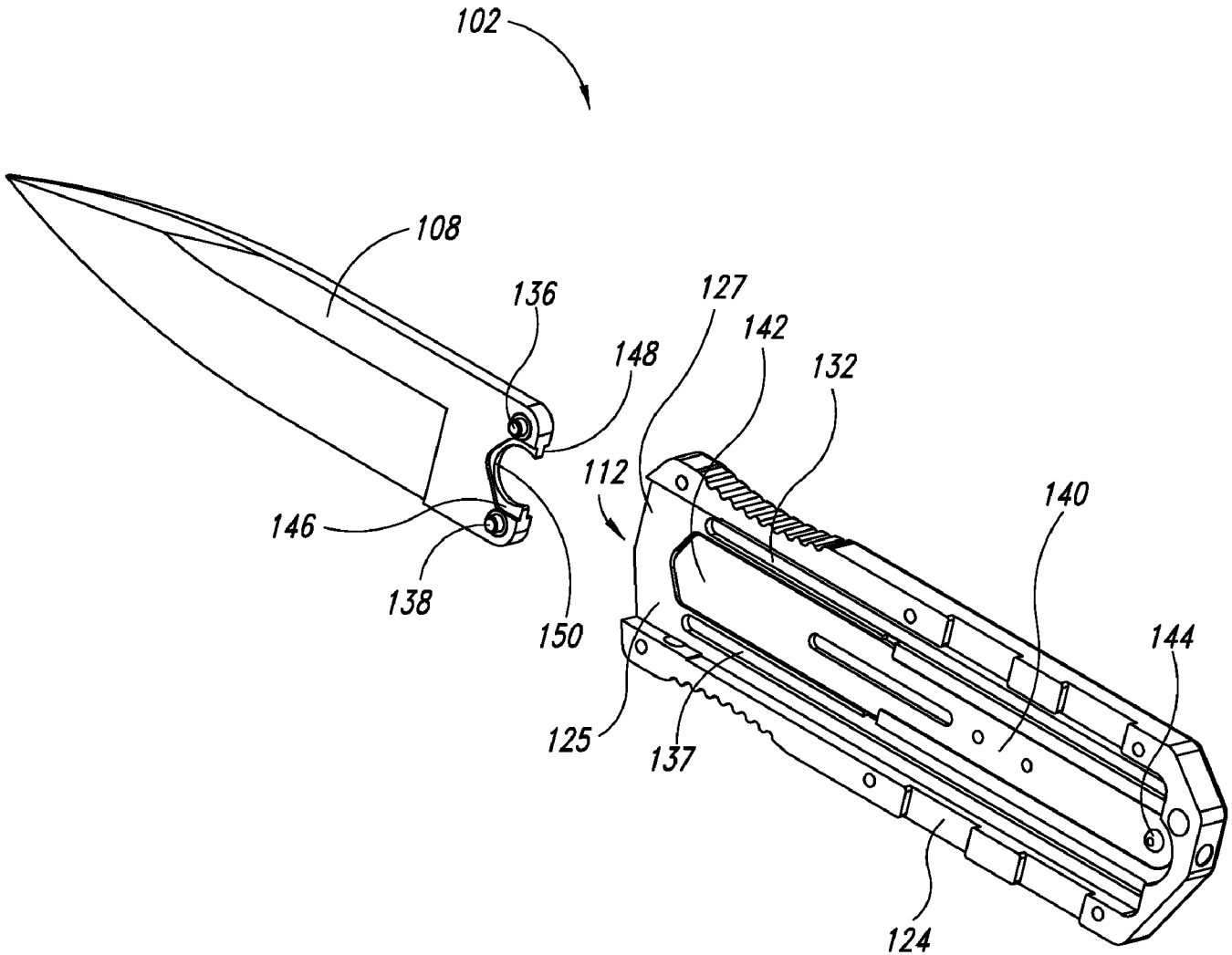
FIG. 3 is a partial view of the knife of FIG. 1, showing details of the knife.

FIG. 3 shows a partial view of the knife 102; in particular, the handle 106 is shown with the front cover 122 removed to show details of the blade cavity 125, and the blade 108 is shown separate from the handle 106.

The blade cavity 125 has a form suitable to slideably receive the blade 108 via a blade aperture 127 extending out the first end 112 of the handle 106. The blade cavity 125 includes alignment grooves 132, 137 formed in the back cover 124, with corresponding alignment grooves formed in the front cover 122. A lock plate 140 is positioned within the blade cavity 125 and includes a lock tab 142 and a detent bump 144. The lock plate 140 is formed of a spring material such as steel, titanium, or the like. The lock tab 142 tends to deflect upward from the lower surface of the blade cavity 125 so as to lock the blade 108 in the extended position, as will be described in more detail with reference to FIGS. 4A-4D. The blade cavity 125 also includes a detent release cavity 154 formed in the back cover 124 in a position corresponding to the detent bump 144 (see FIGS. 4B-4D).

The blade 108 is provided with a lock notch 148 on the side facing the back 120 of the knife handle 106. The blade 108 of FIG. 4 is shown with a second lock notch 146 formed on the side of the blade 108 facing the front 118 of the handle 106. This second lock notch 146 is provided as a mirror of the lock notch 148 to illustrate that the lock notch 148 is shaped to receive the lock tab 142 when the blade 108 is in the extended position. It will be recognized that the second lock notch is not required for proper operation of the knife assembly 100. On the other hand, it will also be recognized that if the blade 108 is provided with first and second lock notches 146, 148 as shown, the blade 108 may be positioned with the cutting edge facing the top of the handle 116 for more convenient use by left-handed users.

The blade 108 is also provided with first and second alignment dowels 136, 138 that extend outward on either side of the blade 108 and engage the alignment grooves 132, 137, respectively, of the back cover 124, as well as the corresponding grooves of the front cover 122. As the blade 108 moves between the retracted and extended positions, the dowels 136, 138 travel within the alignment grooves 132, 137. The dimensions of the grooves 132, 137, in cooperation with the dowels 136, 138, serve to limit the travel of the blade 108 between the extended and retracted position. The engagement between the dowels and grooves also serves to stabilize and align the blade 108 within the blade cavity 125. The dowels 136, 138 may be formed integrally with the blade 108 or may be formed separately and attached thereto by any suitable means. For example, the dowels may be attached to the surfaces of the blade by welding, or the blade may be provided with apertures, the dowels positioned therein to extend from the sides, and affixed via welding or epoxy cement, or they may be threaded and received into threaded apertures in the blade 108. According to one embodiment, nylon sleeves are positioned around the dowels between the dowels and apertures formed in the blade. These sleeves permit a slight resilient movement of the dowels relative to the blade, and serve to retain the dowels in place while reducing or eliminating play in the blade while locked in the extended position.

A pin engagement notch 150 is formed in a tang portion of the blade 108 and positioned such that, when the blade 108 is in the extended position, the pin engagement notch 150 is substantially coaxial with the release aperture 128 formed in the front cover 122. When the pin 133 of the clip assembly 104 is positioned within the blade cavity 125 via the release aperture 128, the head 134 engages the pin engagement notch 150. Accordingly, as the pin 133 moves along the deployment slot 126, the blade 108 is drawn into the blade cavity 125.

Figure 4A:
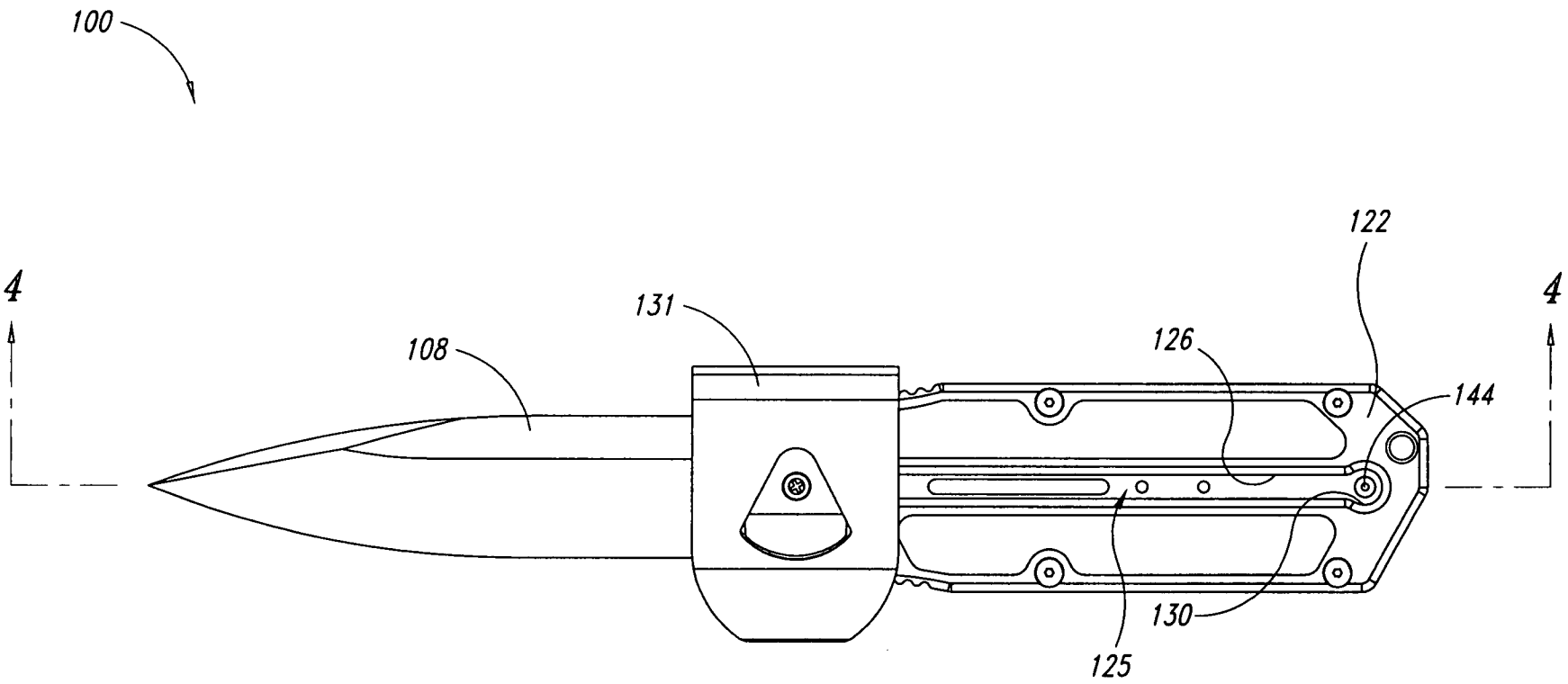
FIG. 4A is a plan view of a knife assembly according to the embodiment of FIG. 1.
Figures 4B, 4C, 4D:
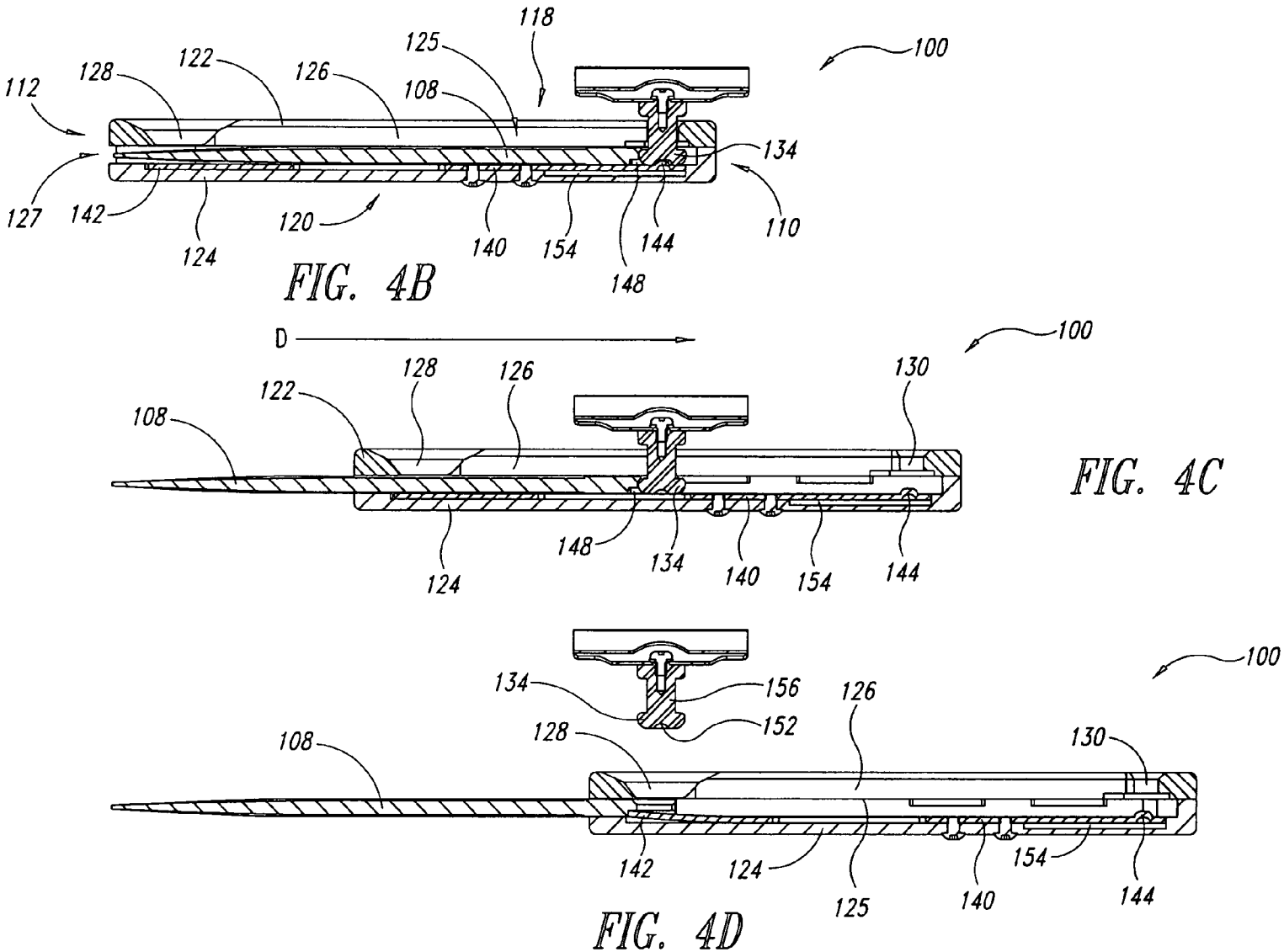
FIGS. 4B-4D are cross-sectional views of the knife assembly shown in FIG. 4A taken along the lines 4-4 and showing the operation of the deployment mechanism.

FIG. 4A shows the knife assembly 100 in plan view, with the clip assembly 104 positioned such that the pin 133 is located over the release aperture 128, and with the blade 108 in the extended position. FIGS. 4B, 4C, and 4D show cross sections of the knife assembly 100 taken along the lines 4-4 of FIG. 4A, and will be referred to hereafter to describe the operation of the knife assembly 100 in deploying or retracting the blade 108.

FIG. 4B shows the knife assembly 100 with the blade 108 in the retracted position, in which the blade 108 is fully received in the blade cavity 125 and the pin 133 is engaged with the handle 106 via the swivel aperture 130 of the deployment slot 126. The head 134 is shown having a detent cavity 152, which engages the detent bump 144 while the blade 108 is in the retracted position.

To deploy the blade 108 from the retracted position as shown in FIG. 4B, the user grasps the handle 106 and moves the handle 108 to the right, as oriented in FIG. 4C, and as indicated by the arrow D. As the handle moves to the left, the clip 131, attached to the user's belt, does not move with the handle 106, but remains in place. When sufficient force is applied to overcome the resistance of the engagement between the detent cavity 152 and the detent bump 144, the end of the lock plate 140 on which the detent bump 144 is formed deflects into the detent release cavity 154, releasing the blade from the retracted position. The head 134, positioned in the pin engagement notch 150 of the blade 108, prevents the blade 108 from moving with the handle, and accordingly, the blade 108 begins to exit the blade cavity 125 via the blade aperture 127, as illustrated in FIG. 4C.

When the handle 106 has been moved until the pin 133 reaches the release aperture 128, the blade 108 is arrested by the dowels 136, 138 as they reach the ends of the alignment grooves 132, 137, and the lock tab 142 engages the lock notch 148. The upward movement of the lock tab 142 pushes upward on the head 134, which helps move the knife 102, with the blade 108 fully extended, away from the clip assembly 104, as shown in FIG. 4D.

To retract the blade 108, the procedure outlined above is merely reversed. In particular, the user holds the knife 102 such that the release aperture 128 is approximately aligned with the pin 133, and then moves the knife 102 against the pin 133 so that the head 134 enters the release aperture 128 and is pressed against the lock tab 142. Pressure of the head 134 against the tab 142 moves the tab away from engagement with the lock notch 148 of the blade 108, releasing the blade for retraction. The user then moves the handle 106 to the left (as viewed in FIGS. 4B-4D) until the detent bump 144 again engages the detent cavity 152. The knife 102 can then be released to hang securely from the clip assembly 104.

Figure 5A:
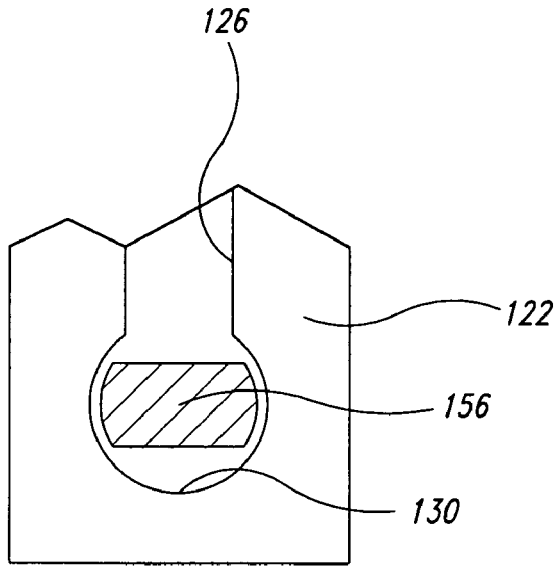
FIGS. 5A and 5B are partial cross sectional views of the pin and swivel aperture of the knife of FIG. 1.
Figure 5B:
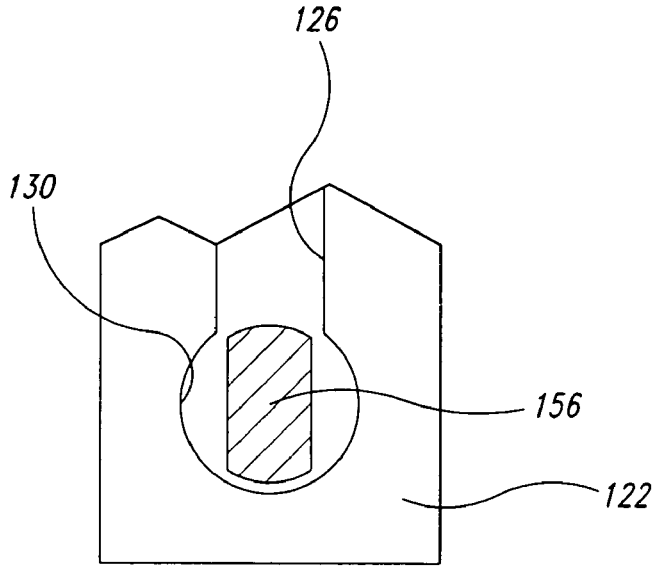

Referring now to FIGS. 5A and 5B, a small portion of the front cover 122 is shown, comprising the swivel aperture 130 and a portion of the deployment slot 126. A cross section of the body 156 of the pin 133 is shown diagrammatically to illustrate a safety feature according to an embodiment of the invention. It can be seen that the body 156 has an oblong shape such that it is longer in a first dimension. Furthermore, it will be observed that, while the body 156 is oriented as shown in FIG. 5A with respect to the front cover 122, the body will not pass into the deployment slot 126 from the swivel aperture 130. This orientation corresponds to the orientation illustrated in FIG. 2 of the clip assembly 104 relative to the knife 102. In this position, the blade 108 cannot be deployed. This serves to safeguard against accidental deployment while knife 102 hangs from the user's belt, and as the user moves or sits.

On the other hand, when the body 156 is aligned relative to the cover 122, as shown in FIG. 5B, the pin 133 can be moved into the deployment slot 126 to move the blade 108 toward the extended position. This orientation corresponds to the orientation of the clip assembly relative to the knife as illustrated in FIG. 4A, in which the blade can be moved between the extended and retracted positions. Accordingly, in order to deploy the blade 108, the user rotates the handle 106 approximately 90° with the first end of the knife 102 toward the front, and pulls back on the handle 106.

Embodiments of the invention afford several advantages over conventional sheath or pocket knives. For example, though the knife is securely and safely held by the clip assembly while not in use, the knife is released from the clip assembly and the blade is deployed in a single movement by the user, which means that it is instantly available. Because it can be deployed with one hand, the user can access the knife while the other hand is occupied. Because there are no fingernail notches, thumb studs, or other features that require close attention or dexterity, a knife according to the principles of the invention is especially suited for use in environments where the user may be wearing gloves or mittens, may have cold or stiff hands, or may not be able to look while reaching for the knife. Finally, because the blade is stored within the handle, the knife occupies a smaller area on the user's belt, and does not interfere with physical movement to the extent that a fixed-blade knife of similar blade and handle dimensions would.

FIGS. 6-10B diagrammatically illustrate additional embodiments of the invention. Many of the features shown are similar in function to corresponding features of the embodiment described above with reference to FIGS. 1-5B. Accordingly, one of ordinary skill in the art will readily understand the features and operation of the additional embodiments without repeating the entire detailed description. Of course, unique features will be described to the extent necessary to provide a complete understanding to one skilled in the art.

Figure 6:
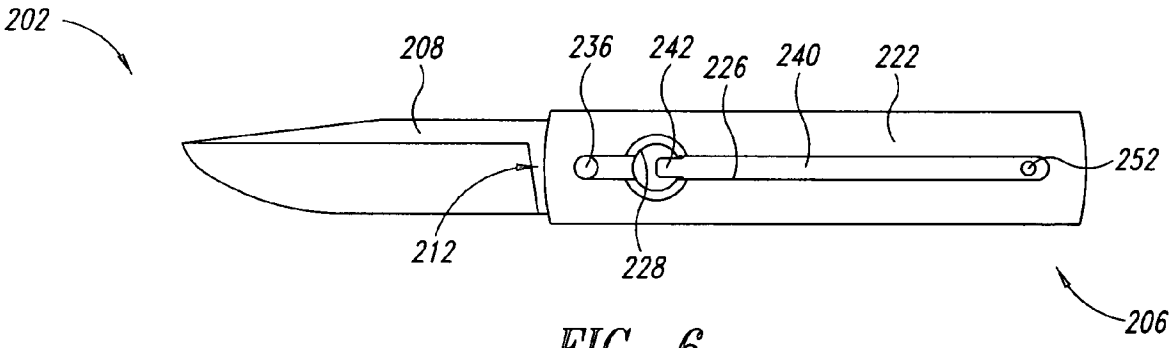
FIG. 6 is a diagrammatical representation of a knife according to another embodiment of the invention, shown in plan view.

Referring to FIG. 6, a knife 202 is shown having a handle 206 with a blade 208 slideably received therein. As described with reference to the embodiment of FIGS. 1-5B, the blade 208 is slideably engaged to the handle 206 such that it is translatable between a retracted position in which the blade 208 is stored in a blade cavity 225, and an extended position in which the blade extends from a first end 212 of the handle 206. In the embodiment of FIG. 6, a front cover 222 of the handle 206 includes a deployment slot 226 and a release aperture 228. However, in this embodiment, the deployment slot 226 extends beyond the release aperture 228 toward the first end 212 of the handle 206, as shown in FIG. 6. An alignment pin 236 extends outwardly from the blade 208 in the direction of the front cover 222 and moves within the deployment slot 226 as the blade moves between the retracted and extended positions. This arrangement serves to guide and stabilize the blade 208 as it moves between the retracted and extended positions. In FIG. 6 the deployment pin 236 is shown in contact with the extreme end of the deployment slot 226, which serves to arrest the blade 208 when it reaches the extended position. A lock plate 240 is positioned within the blade cavity 225 and serves to lock the blade in the extended position, as described in more detail with reference to FIGS. 7-9.

Figure 7:
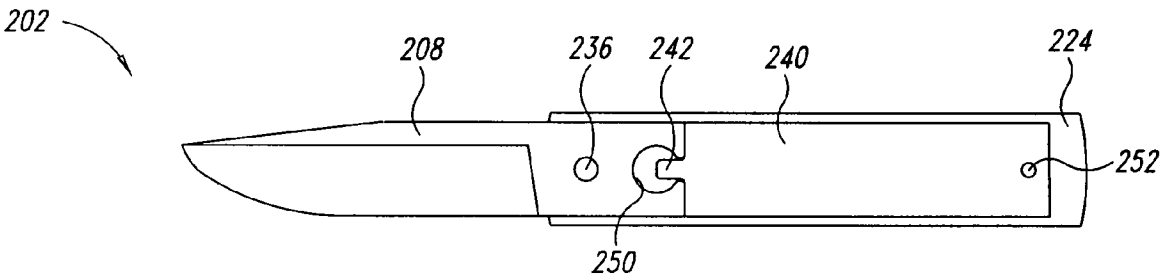
FIG. 7 shows the knife of FIG. 6 with an outer cover removed to show interior details.
Figure 9:
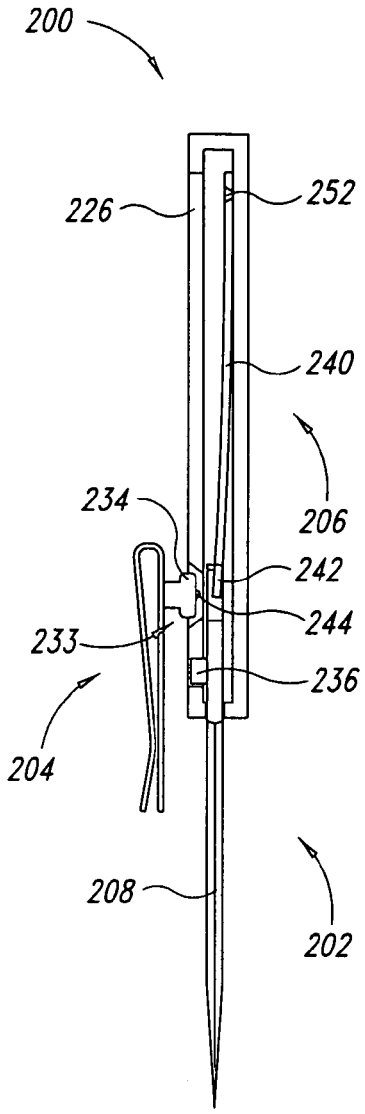
FIG. 9 shows, in a diagrammatical side view, a knife assembly incorporating the knife of FIG. 6.

FIG. 7 shows a view of the knife 202 with the front cover 222 removed from the knife 202. It may be seen that the lock plate 240 is configured to engage a locking surface 247 on a rear portion of the tang of the blade, while a lock tab 242 extends into a pin engagement notch 250 of the blade 208, as shown in FIG. 9. The lock plate 240 also includes a detent cavity 252.

Figure 8:
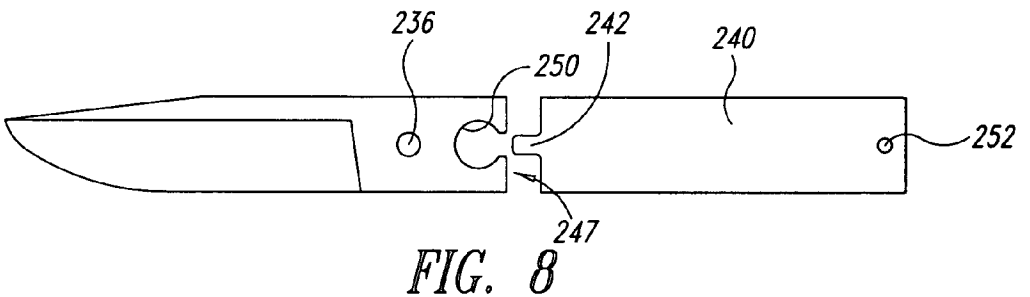
FIG. 8 is a view of some of the components of the knife of FIG. 6.

FIG. 8 shows the blade 208 and lock plate 240 spaced slightly apart to show the relative shapes of the lock plate 240 and the blade 208.

Referring now to FIG. 9, the knife 202 is shown as part of a knife assembly 200 including a clip assembly 204. FIG. 9 shows, diagrammatically, a side view of the knife assembly 200. Knife 202 is shown with the blade 208 in the extended position, in which it can be seen that the lock plate 240 engages the lock engagement surface 247 of the blade 208 to hold the blade securely in the extended position. The general operation of the knife assembly 200 is similar to that of the knife assembly 100, in that a pin 233 of the clip assembly 204 engages the pin engagement notch 250 of the blade 208 such that translation of the handle 206 relative to the clip assembly 204 will extend or retract the blade 208. In the embodiment pictured in FIG. 9, the head 234 includes a spring-loaded detent bump 244 that is configured to engage the detent cavity 252 when the knife is in the retracted position.

Figure 10A:
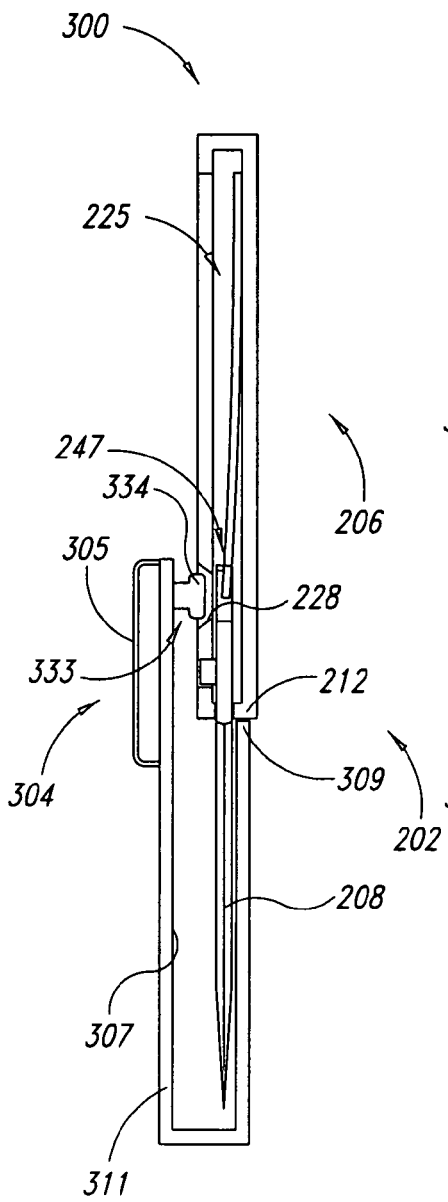
FIGS. 10A and 10B show, in two different configurations, a knife assembly according to another embodiment of the invention that incorporates the knife of FIG. 6.

Referring now to FIG. 10A, a knife assembly 300 is shown, including a clip assembly 304 and a knife 202. While the knife 202 of FIG. 10A is substantially identical to the knife 202 of FIGS. 6-9, it will be recognized that the clip assembly 304 may also be configured to accommodate a knife such as that described with reference to FIGS. 1-5B, as well as other knives configured according to embodiments of the invention.

Figure 10B:
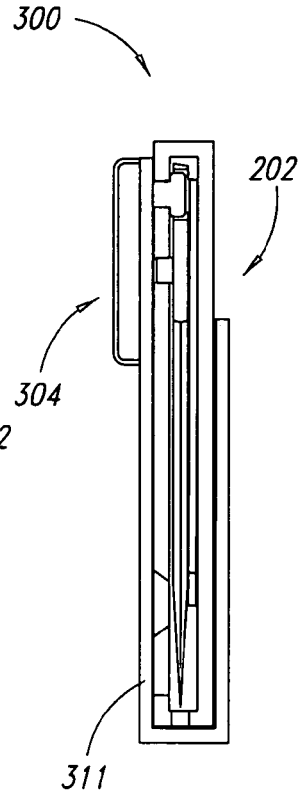

The clip assembly 304 incorporates a sheath 311 into which the knife 202 is configured to be received. A loop 305 is configured to receive a user's belt therethrough for attachment. The sheath 311 includes a front lip 309 and an interior cavity 307. The front lip 309 is sized and positioned such that, when the user places the blade 208 of the knife in the interior cavity 307 of the sheath 311, a first end 212 of the handle 204 makes contact with the lip 309 in a position that aligns the pin 333 of the clip assembly 304 with the release aperture 228 of the handle 206. The knife 202 cannot be moved further into the sheath 311 until the handle 206 is moved closer to a back portion of the clip assembly 304. As the user pushes the handle 206 toward the back of the clip assembly 304 to bring the handle 206 into alignment with the interior cavity 307 of the clip assembly 304, the head 334 of the pin 333 is pressed against the lock tab 242 of the knife 202, deflecting the lock plate 240 and thereby releasing the blade 208 from the extended position. From here, the user simply slides the handle 206 into the sheath 311, which action causes the blade 208 to retract into the handle 206 to the retracted position as shown in FIG. 10B.

Because the sheath assembly 304 is configured to substantially enclose the knife 202 while not in use, the knife 202 is protected from contact with other surfaces that might initiate an accidental deployment of the blade. Accordingly, a detent mechanism such as those described with reference to other embodiments of the invention is not required.

According to an embodiment of the invention, a knife assembly may be provided with more than one clip assembly, such as, for example, a sheath similar to the sheath 311 of FIGS. 10A and 10B, and a clip assembly similar to one of those described with reference to FIGS. 1-9. Accordingly, the user may select the clip assembly that is most appropriate for a given application.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A knife assembly, comprising:

a blade;

a handle having a cavity configured to receive the blade therein such that the blade is slidable between an extended position and a retracted position;

a deployment slot formed in the handle, the deployment slot extending along a portion of a length of the handle and traversing the handle from an exterior surface thereof to the cavity; and an engagement member configured to engage a tang of the blade via the deployment slot for movement of the blade between the extended and retracted positions, the engagement member further configured to serve as a support from which the handle is configured to hang while the blade is in the retracted position, and to be separable from the handle and the blade while the blade is in the extended position to permit use of the handle and the blade while separate from the engagement member.

2. The knife assembly of claim 1 wherein the engagement member includes a clip configured to attach to a user's belt.

3. The knife assembly of claim 1 wherein the engagement member comprises a support member and a pin, the pin including a body extending between the support member and a head of the pin, and the blade comprises a pin engagement notch, and wherein the head is configured to engage the pin engagement notch of the blade.

4. The knife assembly of claim 3 wherein the body has a first dimension greater than a width of the deployment slot and a second dimension less than the width of the deployment slot such that the deployment slot must be substantially aligned with the second dimension of the body of the pin in order to move the blade between the retracted and extended positions.

5. A knife assembly comprising:

a handle having a blade cavity and a deployment slot, the deployment slot traversing the handle from an exterior surface thereof to the blade cavity;

a blade positioned within the blade cavity and slidable between a retracted position in which the blade is wholly enclosed within the handle, and an extended position in which a portion of the blade extends from a first end of the handle; and a clip assembly, including a pin configured to releasably engage a tang portion of the blade in the blade cavity via the deployment slot, and further configured to traverse the deployment slot from a first end to a second end thereof to move the blade between the extended and retracted positions, the handle configured to hang from the pin at the second end of the deployment slot while the blade is in the retracted position, to be separable from the clip assembly, and to retain the blade in the extended position while the handle is separated from the clip assembly.

6. The knife assembly of claim 5 wherein the clip assembly includes a support member, and the pin includes a head and a body extending along a first axis between the support member and the head of the pin such that, when the pin traverses the deployment slot, the body extends between the head and the support member via the deployment slot.

7. The knife assembly of claim 6 wherein the handle includes a release aperture at the first end of the deployment slot, the release aperture having a diameter that is greater than a diameter of the head of the pin and configured to removably receive the head, the deployment slot having a width that is less than the diameter of the head.

8. The knife assembly of claim 7 wherein the body of the pin has a first dimension, along a second axis perpendicular to the first axis, that is less than the width of the deployment slot, and a second dimension, along a third axis perpendicular to the first and second axes, that is greater than the width of the deployment slot.

9. The knife assembly of claim 8 wherein the handle includes a swivel aperture at the second end of the deployment slot having a diameter that is greater than the second dimension of the body and less than the diameter of the head.

10. The knife assembly of claim 9 wherein the body of the pin is oriented such that, when the handle hangs from the pin, the second axis of the body is substantially parallel to the deployment slot of the handle.

11. The knife assembly of claim 10 wherein the clip assembly includes a clip configured to engage a user's belt.

12. The knife assembly of claim 5 wherein the clip assembly comprises a sheath configured to be carried on a user's belt, the sheath including a lip positioned such that, when the handle of the knife, with the blade in extended position, is moved into initial engagement with the clip assembly with the blade extending into the sheath, the lip of the sheath engages the handle to approximately align the pin for engagement with the tang portion of the blade.

13. The knife assembly of claim 5 wherein the handle includes a detent bump positioned within the blade cavity, and the head of the pin includes a detent cavity, the detent bump and the detent cavity positioned and configured such that when the pin is at the second end of the deployment slot the detent bump engages the detent cavity.

14. The knife assembly of claim 5 wherein the handle includes a lock plate positioned within the blade cavity, the lock plate configured to engage the tang portion of the blade while the blade is in the extended position.

15. The knife assembly of claim 14 wherein the tang portion of the blade includes a notch configured to receive an end of the lock plate.

16. The knife assembly of claim 14 wherein the lock plate and the tang portion of the blade are configured such that engagement of the head of the pin with the tang portion of the blade releases engagement of the lock plate with the tang portion of the blade.

17. A knife assembly, comprising:

a handle having a blade cavity and a deployment slot, the deployment slot traversing the handle from an exterior surface thereof to the blade cavity;

a blade positioned within the blade cavity and slidable between a retracted position in which the blade is wholly enclosed within the handle, and an extended position in which a portion of the blade extends from a first end of the handle;

a lock plate coupled to the handle within the blade cavity and positioned to engage a tang portion of the blade while the blade is in the extended position; and a clip assembly, separable from the handle and the blade, that engages the tang portion of the blade in the blade cavity via the deployment slot and traverses the deployment slot from a first end to a second end thereof to move the blade between the extended and retracted positions.

18. The knife assembly of claim 17 wherein engagement of the tang portion of the blade by the clip assembly disengages the lock plate from the tang portion of the blade.

19. The knife assembly of claim 17 wherein respective sizes and shapes of the clip assembly and the deployment slot are such that the clip assembly can engage and disengage from the tang portion of the blade only while the blade is in the extended position.

20. A knife assembly, comprising:

a blade;

a handle having a cavity configured to receive the blade therein such that the blade is slidable between an extended position and a retracted position;

a deployment slot formed in the handle and extending along a portion of a length thereof; and an engagement member having a support member and a pin, the pin including a body extending between the support member and a head of the pin, the head of the pin configured to engage a tang of the blade via the deployment slot for movement of the blade between the extended and retracted positions, the body having a first dimension greater than a width of the deployment slot and a second dimension less than the width of the deployment slot such that the deployment slot must be substantially aligned with the second dimension of the body of the pin in order to move the blade between the retracted and extended positions, and the engagement member configured to be separable from the handle and the blade while the blade is in the extended position to permit use of the handle and the blade while separate from the engagement member.

21. A knife assembly, comprising:

a blade;

a handle having a cavity configured to receive the blade therein such that the blade is slidable between an extended position and a retracted position;

a deployment slot formed in the handle, the deployment slot extending along a portion of a length thereof and traversing the handle from an exterior surface thereof to the cavity; and an engagement member having a first dimension greater than a width of the deployment slot and a second dimension less than the width of the deployment slot, the engagement member configured to engage the blade via the deployment slot for movement of the blade between the extended and retracted positions when the second dimension of the engagement member is substantially aligned with the deployment slot, the engagement member further configured to be separable from the handle and the blade while the blade is in the extended position to permit use of the handle and the blade while separate from the engagement member.

22. A knife assembly, comprising:

a blade;

a handle having a cavity configured to receive the blade therein such that the blade is slidable between an extended position and a retracted position;

a deployment slot formed in the handle and extending along a portion of a length of the handle and traversing the handle from an exterior surface thereof to the cavity; and an engagement member having a first dimension less than the width of the deployment slot and configured to engage the blade from the exterior surface of the handle via the deployment slot for movement of the blade between the extended and retracted positions when the first dimension of the engagement member is substantially aligned with the deployment slot, the engagement member further configured to be separable from the handle and the blade while the blade is in the extended position to permit use of the handle and the blade while separate from the engagement member.

* * * * *